United States Patent [19]

Kurland et al.

[11] 4,332,621

[45] Jun. 1, 1982

[54] CONTINUOUSLY OPERABLE CENTRIFUGAL FOR MIXING AND CURING SUGAR MASSECUITES

[75] Inventors: Heinrich Kurland, Lucklum; Helmut Schaper, Brunswick; Joachim Schueller, Walle, all of Fed. Rep. of Germany

[73] Assignee: Braunschweigische Maschinenbauanstalt, Brunswick, Fed. Rep. of Germany

[21] Appl. No.: 206,641

[22] Filed: Nov. 13, 1980

[30] Foreign Application Priority Data

Dec. 4, 1979 [DE] Fed. Rep. of Germany ..... 2948691

[51] Int. Cl.[3] ..... C13F 1/06; C13F 1/10

[52] U.S. Cl. ..... 127/19; 210/377

[58] Field of Search ..... 127/19; 210/377

[56] References Cited

U.S. PATENT DOCUMENTS 4,008,098 2/1977 Dietzel et al. ..... 127/19

4,063,959 12/1977 Dietzel et al. ..... 127/19

FOREIGN PATENT DOCUMENTS 2608911 9/1977 Fed. Rep. of Germany ..... 127/19

*Primary Examiner*—Michael S. Marcus

*Attorney, Agent, or Firm*—W. G. Fasse; D. H. Kane, Jr.

[57] ABSTRACT

A continuously operable sugar centrifugal for mixing and curing sugar massecuites includes an intermediate mixing device between inner and outer centrifugal baskets. The mixing device is formed by a ring housing with an impact zone, retaining zone, and inclined baffles to impart turbulence and transform the kinetic energy of sugar received from the inner basket into the work of mechanical mixing. Mixing liquid is introduced into the received sugar and the mixture eventually passes over the lower edge of the mixing device into the outer basket for final separation and curing. The mixing device is stationary relative to the inner basket or rotates at a slower speed and may assume a variety of advantageous geometries.

8 Claims, 4 Drawing Figures

Figure 1:
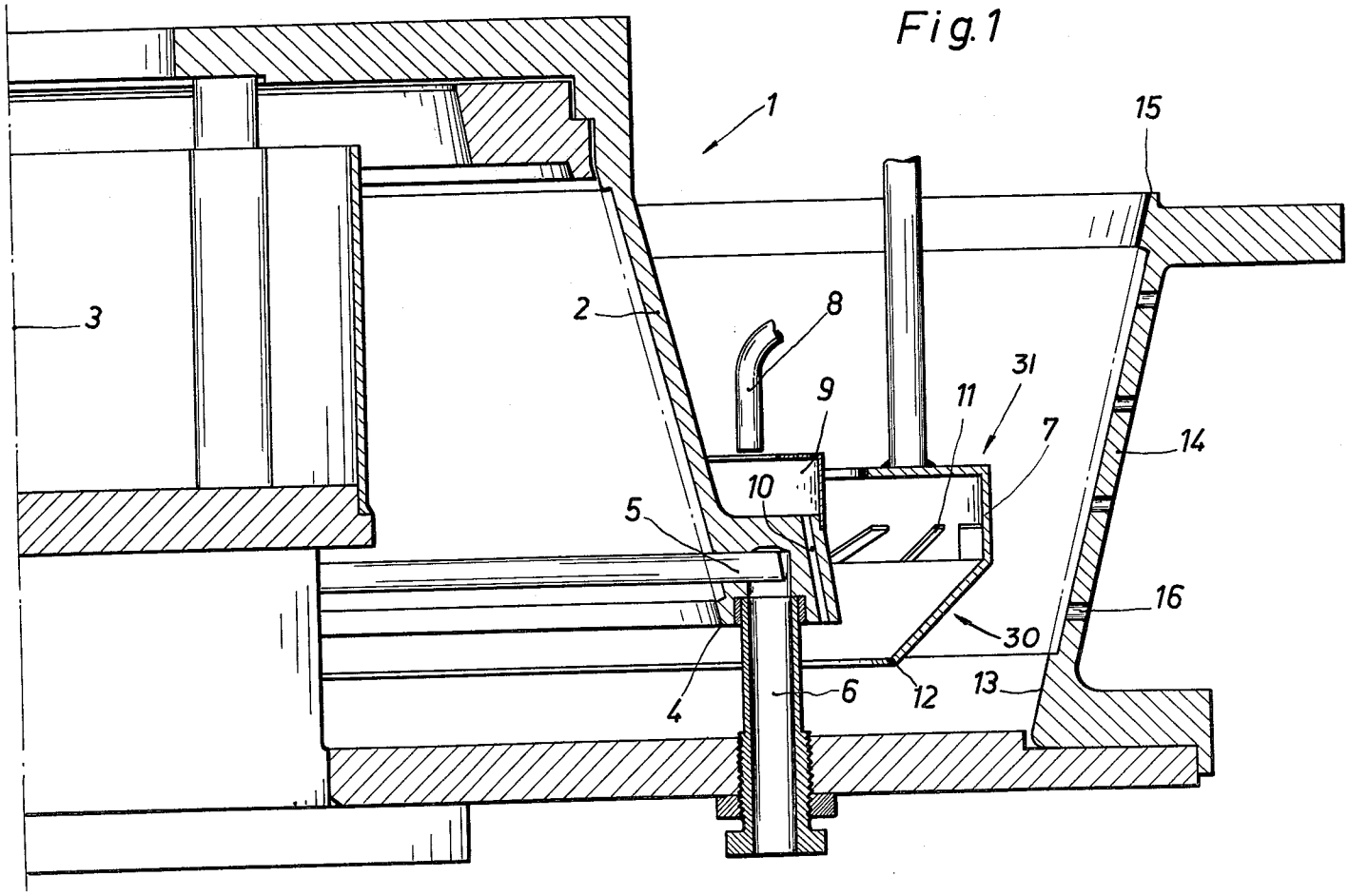

1
2
3
4
5
6
7
8
9
10
11
12
13
14
15
16
30
31

CONTINUOUSLY OPERABLE CENTRIFUGAL FOR MIXING AND CURING SUGAR MASSECUITES

CROSS-REFERENCE TO RELATED APPLICATION

The present invention relates to German patent application No. P 2,948,691.7, filed in the Federal Republic of Germany on Dec. 4, 1979. The priority of said German filing date is hereby claimed.

BACKGROUND OF THE INVENTION

The invention relates to a continuously operable sugar centrifuge or centrifugal for mixing and curing sugar massecuites in which the acceleration bell is constructed as a precentrifuging drum. An intermediate working device is operatively arranged between this precentrifuging drum or so-called "foreworking basket" and the following upwardly open centrifugal basket which rotates around a vertical axis. West German Patent (DE-OS) No. 2,608,911 describes a known centrifugal of the foregoing general type particularly suited for curing white sugar. Because it is preferably limited to curing white sugar, it is sufficient as an intermediate treatment after foreworking to wash the nearly clean sugar crystals. For this reason, the intermediate working device consists of a washing ring providing a ramming or ponding effect, and is secured to the lower end of the outer centrifugal basket.

If only because of the higher viscosity of the liquid phase, such a washing process does not suffice for treating low-purity and medium-purity massecuites and mechanical mixing becomes indispensable.

OBJECTS OF THE INVENTION

In view of the above it is the aim of the invention to achieve the following objects singly or in combination:

to provide a sugar centrifugal capable of mixing and curing low-purity and medium-purity massecuites as well as white sugar;

to provide a centrifuge with an intermediate working device designed for mechanical mixing of the massecuites;

to provide a single centrifuge which accomplishes the work of at least two former centrifuges or two centrifugals and a separate mixing device;

to provide in a sugar centrifuge an intermediate working device which transforms the kinetic energy of sugar and mixing liquid received in the device into turbulent and whirling motions for mechanical mixing; and to provide advantageous variations in the geometry of the intermediate working device.

SUMMARY OF THE INVENTION

In order to accomplish these results the present invention provides a continuously operable sugar centrifuge or centrifugal for mixing and curing sugar massecuites in which the acceleration bell comprises a downwardly opening inner centrifugal basket. The inner basket includes a separating screen for preworking and separating the sugar massecuites into sugar and syrup. The inner basket is formed with a lower edge or drop edge for delivering the separated sugar while the syrup is collected and discharged. An upwardly opening outer centrifugal basket is mounted for rotation coaxially about the inner basket for delivering separated sugar over an upper edge.

According to the invention an intermediate mixing device in the form of a ring housing is positioned between the inner and outer baskets around the lower drop edge of the inner basket. The ring housing is open at the inside for receiving sugar delivered over the lower edge of the inner basket. Mixing or mashing liquid is also introduced at this lower edge. The intermediate mixing device is independently mounted so that the inner basket moves at a greater speed than the ring housing which is stationary or slowly rotating.

The invention further contemplates that the ring housing has an outwardly and upwardly sloping impact zone and a retaining zone casing over the impact zone for partially confining the mixture. Inclined baffles arranged around the circumference of the ring housing impart turbulence for mechanical mixing. A feature and advantage of this arrangement is that the centrifuge is particularly suited for handling lower grade massecuites in addition to white sugar.

In order to introduce mixing liquid the invention provides a continuously supplied annular tank positioned outside the inner basket with downwardly and outwardly extending ducts leading toward the lower edge of the inner basket. Mixing liquid is thereby introduced into the sugar delivered over the drop edge of the inner basket for turbulent mixing with sugar in the intermediate mixing device. The inner edge of the impact zone of the ring housing is of greater diameter than the inner edge of the partially enclosing retaining zone so that the accumulating mixture in the ring housing is delivered over the lower edge to the outer basket for final separation and curing.

An essential advantage of the invention is that one single centrifugal accomplishes the work of at least two former centrifugals or of two centrifugals and a separate mixing device or mashing device.

However, this advantage can be achieved only because the upper casing-shaped zone of the ring housing is provided with baffles which transform the kinetic energy of the introduced sugar into whirling motions and thus into the work of mechanical mixing with the mixing liquid introduced. When this energy has been used up and the sugar has been mixed, the mash formed (artificial massecuite) no longer can resist the gravity in the casing shaped ring particularly since the casing shaped ring is stationary or rotates just slowly. Hence the mash drops down.

The inclination of the baffles, in conjunction with the kinetic energy and the viscosity of the mash, determines the degree of turbulence of the mash or artificial massecuite.

BRIEF FIGURE DESCRIPTION

Figure 2A:
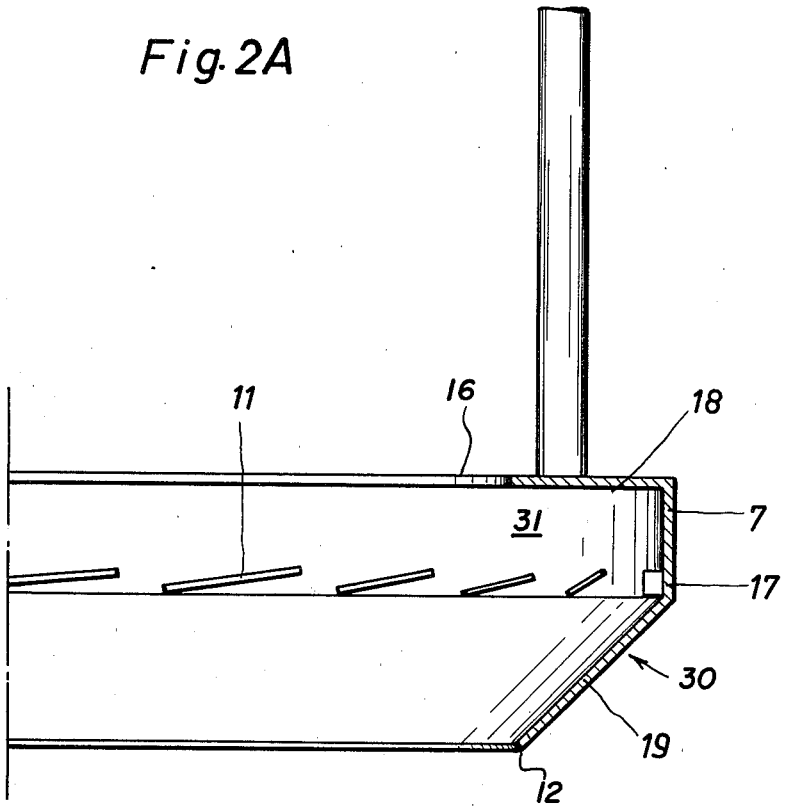
Figure 2B:
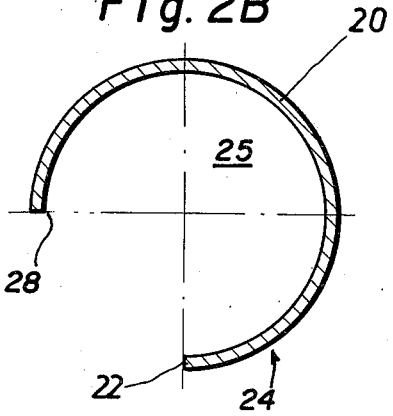
Figure 2C:
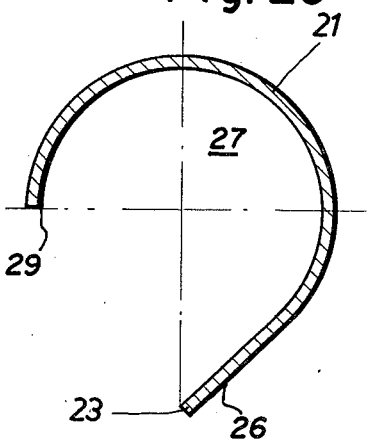

In order that the invention may be clearly understood, it will now be described, by way of example, with reference to the accompanying drawings, wherein:

FIG. 1 is a schematic sectional view showing one embodiment of the invention; and FIGS. 2A, 2B and 2C are detail views of several differently shaped and designed mixing devices in cross-section.

DETAILED DESCRIPTION OF PREFERRED EXAMPLE EMBODIMENTS AND OF THE BEST MODE OF THE INVENTION

FIG. 1 illustrates the nature of the invention, i.e., the common inventive idea encompassing the possible variants.

In a continuously operable sugar centrifugal 1 (shown in part only) a downwardly flared frustum-shaped inner foreworking basket 2 rotating around a vertical axis 3 and provided with a separating screen (not shown) serves for separating sugar massecuites into sugar and syrup.

While the crystalline foreworked sugar, retained by the separating screen, moves toward the lower drop edge 4 of the foreworking basket 2 and leaves same over the edge 4, the syrup passes through the separating screen, accumulates in the syrup collecting ring 5 and leaves same through the discharge pipes 6.

The foreworked sugar leaving the foreworking basket 2 over the drop edge 4 is caught by the stationary or slowly rotating mixing device 7. Through the inlet pipe 8, mixing or mashing liquid flows into a collecting tank 9, wherefrom the centrifugal force pushes it through mixing-liquid ducts 10 into the mixing device 7, wherein sugar and mixing liquid are mixed. The sugar and mixing liquid are received at the impact zone 30 and pass into the retaining zone 31 which together form a ring housing open at the inner side. One or more baffles 11 serve to intensify the mixing process in the mixing device 7.

When the mixing device 7 is filled, the mixed sugar-liquid mixture flows continuously past the lower edge 12 to the lower part 13 of the upwardly flared frustum-shaped outer centrifugal basket 14 coaxially rotating around axis 3.

In the outer centrifugal basket 14 the afterworked sugar moves on a screen (not shown) toward the upper end and over the upper drop edge 15 into the sugar collecting chamber (not shown). The syrup passes through the screen (not shown) and the perforations 16 in the outer centrifugal basket 14 and flows into the outer syrup collecting chamber (not shown).

FIGS. 2A, 2B, and 2C show three possible practical examples of a mixing device 7. The version shown in FIG. 2A was described already in FIG. 1. It shows the baffles 11 which ensure proper mixing of sugar and syrup by turbulence. It is insignificant in this connection whether baffles 11 are fitted at the location 17 as shown or at the inner lid or partial enclosure 18 or at the lower slope 19 of the impact zone.

The sectional view of the mixing device 7 may also have another shape, e.g., as shown in FIGS. 2B and 2C. In these latter cases the mixture would flow past the lower edges 22 and 23, analogous to the lower edge 12, and then into the outer basket 14.

In FIG. 2B the ring housing is circular in cross-section formed by a circular cross-section wall 20 which defines both the impact zone 24 and retaining zone 25. Inclined baffles, now shown are placed at either location. In FIG. 2c the ring housing is formed by a wall 21 of circular cross-section in the region of the retaining zone 27 and opens downwardly into a straight slope at the impact zone 26. Inclined baffles, not shown, are also placed at either location.

For the development according to FIG. 2A it is to be ensured that the inner edge 15 of lid 18 at the retaining zone, analogously with edges 28 and 29 of FIGS. 2B and 2C, has a diameter smaller than inner edge 12 of the impact zone. Thus, inner edge 12 of the impact zone in FIG. 2A serves the same function as inner edges 22 and 23 of the arrangements in FIGS. 2B and 2C.

Although the invention has been described with reference to specific example embodiments, it is to be understood that it is intended to cover all modifications and equivalents within the scope of the appended claims.

What is claimed is:

1. A continuously operable sugar centrifuge for mixing and curing sugar massecuites comprising: acceleration bell means comprising downwardly opening centrifugal inner basket means mounted for rotation about a vertical axis, said inner basket means having separated screen means for preworking and separating sugar massecuites into sugar and syrup and a lower edge for delivering separated sugar; upwardly opening centrifugal outer basket means mounted for rotation coaxially about the inner basket means and having an upper edge for delivering sugar; intermediate mixing means comprising ring housing means intermediate the inner and outer basket means being positioned around the lower edge of the inner basket means and open at the inside for receiving sugar delivered over the lower edge of the inner basket means, said ring housing means being independently mounted for movement about the inner basket means, said ring housing means being formed with an upwardly and outwardly sloping impact zone, a partially enclosing retaining zone over the impact zone, and inclined baffle means arranged around the circumference of the ring housing means for imparting turbulence, said retaining zone having an inner edge and said sloping impact zone having an inner edge of greater diameter than the inner edge of the retaining zone for delivering sugar after mixing to the outer basket means; and mixing liquid feeding means comprising annular tank means outside the inner basket means with downwardly and outwardly extending duct means leading toward the lower edge of the inner basket means for introducing mixing liquid into sugar delivered over the lower edge of the inner basket means for turbulent mixing with the sugar in the intermediate mixing means.

2. The centrifuge of claim 1, wherein the intermediate mixing means is stationary relative to the inner basket means.

3. The centrifuge of claim 1, wherein the intermediate mixing means is mounted for rotation at a speed slower than the inner basket means.

4. The centrifuge of claim 1, wherein said inclined baffles are positioned in the retaining zone of the ring housing means.

5. The centrifuge of claim 1, wherein said inclined baffles are positioned in the impact zone of the ring housing means.

6. The centrifuge of claim 1, wherein said ring housing means comprises a circular cross-section wall open around the inside for receiving sugar and mixing liquid.

7. The centrifuge of claim 6, wherein the impact zone comprises the lower portion of the circular cross-section wall.

8. The centrifuge of claim 1, wherein the retaining zone comprises a circular cross-section wall and the impact zone slopes downwardly from the circular cross-section wall.

* * * * *